US005276271A

United States Patent [19]

Huang et al.

[11] Patent Number: 5,276,271

[45] Date of Patent: Jan. 4, 1994

[54] MUSIC BOX MOTION GENERATION MECHANISM

[76] Inventors: Ching-Fa Huang, 5th Floor, 7-1, Alley 56, Lane 166, Shih Pai Road Sec. 1; Feng-Hsiang Hsu, 7th Floor, No. 9, Lane 100, Her Chiang Street, both of Taipei, Taiwan

[21] Appl. No.: 990,018

[22] Filed: Dec. 14, 1992

[51] Int. Cl.[5] ..... G10F 1/06

[52] U.S. Cl. ..... 84/94.2; 74/53; 74/567

[58] Field of Search ..... 84/94.1, 94.2, 95.1, 84/95.2; 40/430; 74/53, 567

[56] References Cited

U.S. PATENT DOCUMENTS

| | | | |
|---|---|---|---|
| 3,308,705 | 3/1967 | Shinnick | 84/94.2 |
| 5,134,795 | 8/1992 | Wang | 40/430 |
| 5,161,420 | 11/1992 | Feng | 73/53 |

*Primary Examiner*—Michael L. Gellner
*Assistant Examiner*—Cassandra Spyrou
*Attorney, Agent, or Firm*—Browdy and Neimark

[57] ABSTRACT

Improved music box motion generation mechanism is equipped with a wave-shaped cam ring housed at the bottom of the upper housing cavity of a mount case and a rotation disc disposed on top of the cam ring and having a number of symmetric through holes disposed along the periphery thereof and a central through hole located at the center thereof. With each symmetric through hole is associated a fixing member by way of a nut. An actuation rod having a follower disposed at the bottom end thereof is moveably engaged with the fixing member, the rod can move up and down and spin 360 degrees around and travel along with the fixed wave-shaped cam ring. A main shaft is disposed through the central through hole of the rotation disc with its bottom end connected to the music producing and driving shaft of a driving case. A spring tightening knob made in the shape of an umbrella is disposed at the top end of the main shaft whereby the rotational actuation of the knob can make the decoration article attached to each actuation rod spin around and move in circle with the rotation disc and move up and down simultaneously.

4 Claims, 6 Drawing Sheets

MUSIC BOX MOTION GENERATION MECHANISM

BACKGROUND OF THE INVENTION

The present invention relates to an improved music box motion generation mechanism which is equipped with a wave-shaped cam ring and a rotation disc to which a main shaft is fixedly engaged along with a number of actuation rods engaged with the rotation disc by way of fixing members; the bottom of each actuation rod is in abutment against the wave-shaped cam ring. To each actuation rod is attached a decoration article, and onto the top end of the main shaft is mounted a spring tightening knob which can be rotationally actuated so as to make the main shaft and the rotation disc spin, permitting the decoration articles to move up and down and spin 360 degrees around and move in circle along with the rotational disc simultaneouly.

The conventional music box motion generation mechanism is as shown in FIGS. 1, 2, the muscic box 1 is provided with a base mount 11 having a housing cavity 12 in which is disposed a music producing and driving unit 13 equipped with a spring tightening knob 131 used to get a driving spring 132 tightened. A shaft 14 extended upwardly from the knob 131 is provided with a through hole 141 having inner threads 142 disposed thereon. An outer tube 15 having a flanged bottom 151 is used to house the shaft 14 so as to permit the same to be freely rotated. The flanged bottom 151 provided with outer threads 152 is led through a through hole 111 and is secured in place to the base mount 11 by a nut 153 located in the cavity 12.

The shaft 14 is integrally associated with the music producing and driving unit 13 so that the actuation of the turning knob 131 will make the shaft 14 spin. A through hole 141 is disposed at the top end of the shaft 14 with inner threads 142 disposed thereon so that a connection rod 16 having both ends provided with threads 161, 162 can be fixed in place to the shaft 14 with a decoration umbrella 17 having a through hole 171 disposed at the top end thereof attached to the other screwed end of the connection rod 16 by means of a fixing knob 18. A number of decoration articles 191 each mounted onto a securing pole 19 attached to the decoration umbrella 17.

This prior art music box structure is relatively simple, the decoration articles 191 are fixed by the securing poles 19 and can only move circularly with the spring biased shaft 14.

SUMMARY OF THE INVENTION

Therefore, the primary object of the present invention is to provide an improved music box motion generation mechanism which is provided with a rotation disc secured to a spring biased rotatable main shaft and a fixed wave shaped cam ring associated with the rotation disc by way of a number of followers to each of which is attached with an actuation rod that is engaged with the rotation disc so that the spinning of the main shaft can make the decoration articles move circularly and spin 360 degrees around as a result of the contour of the wave-shaped cam ring and up and down simultaneously.

DETAILED DESCRIPTION OF THE PREFERRED EMBODIMENTS

Figure 1:
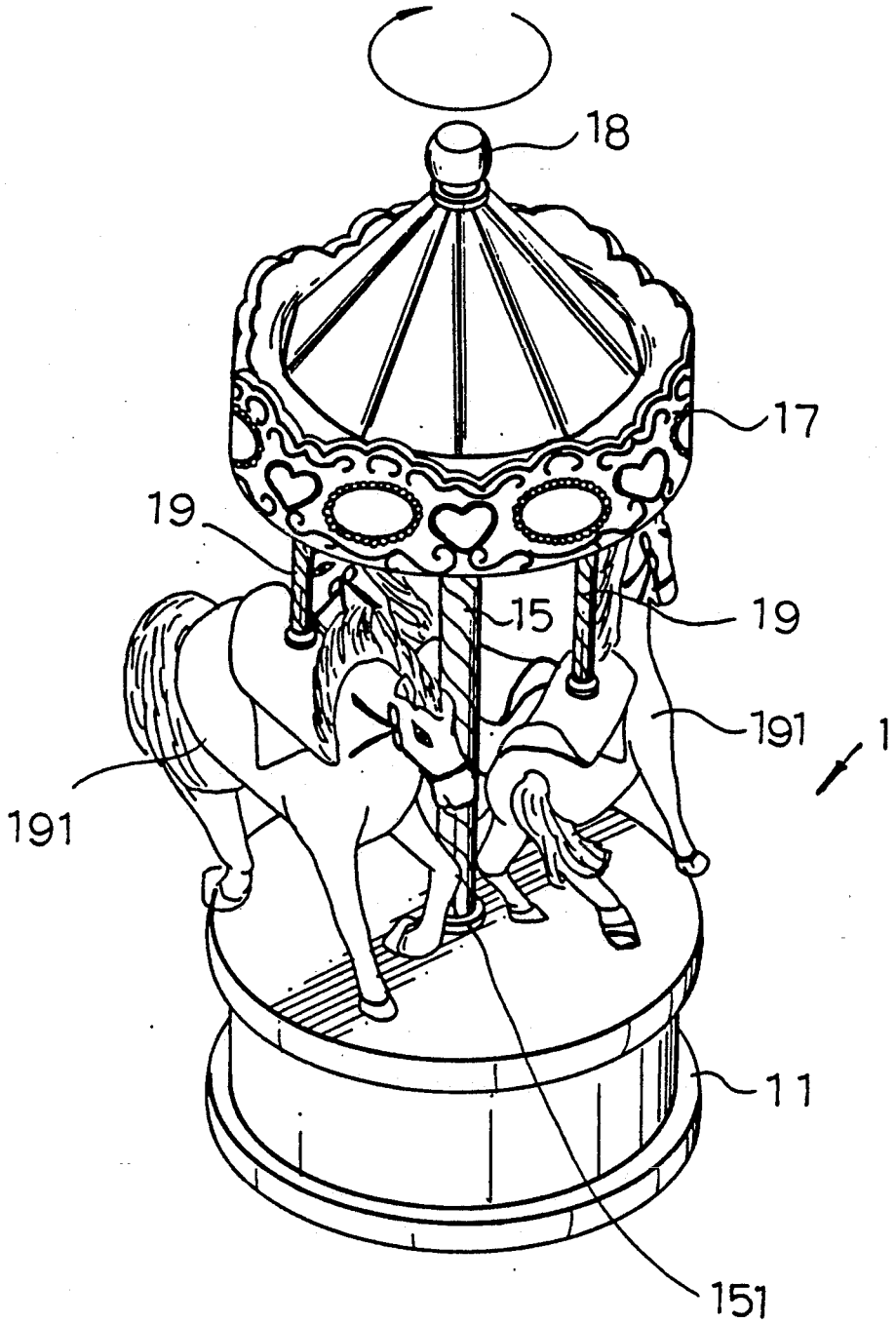
FIG.1 (PRIOR ART)
FIG. 1 is a perspective view of a prior art music box.
Figure 2:
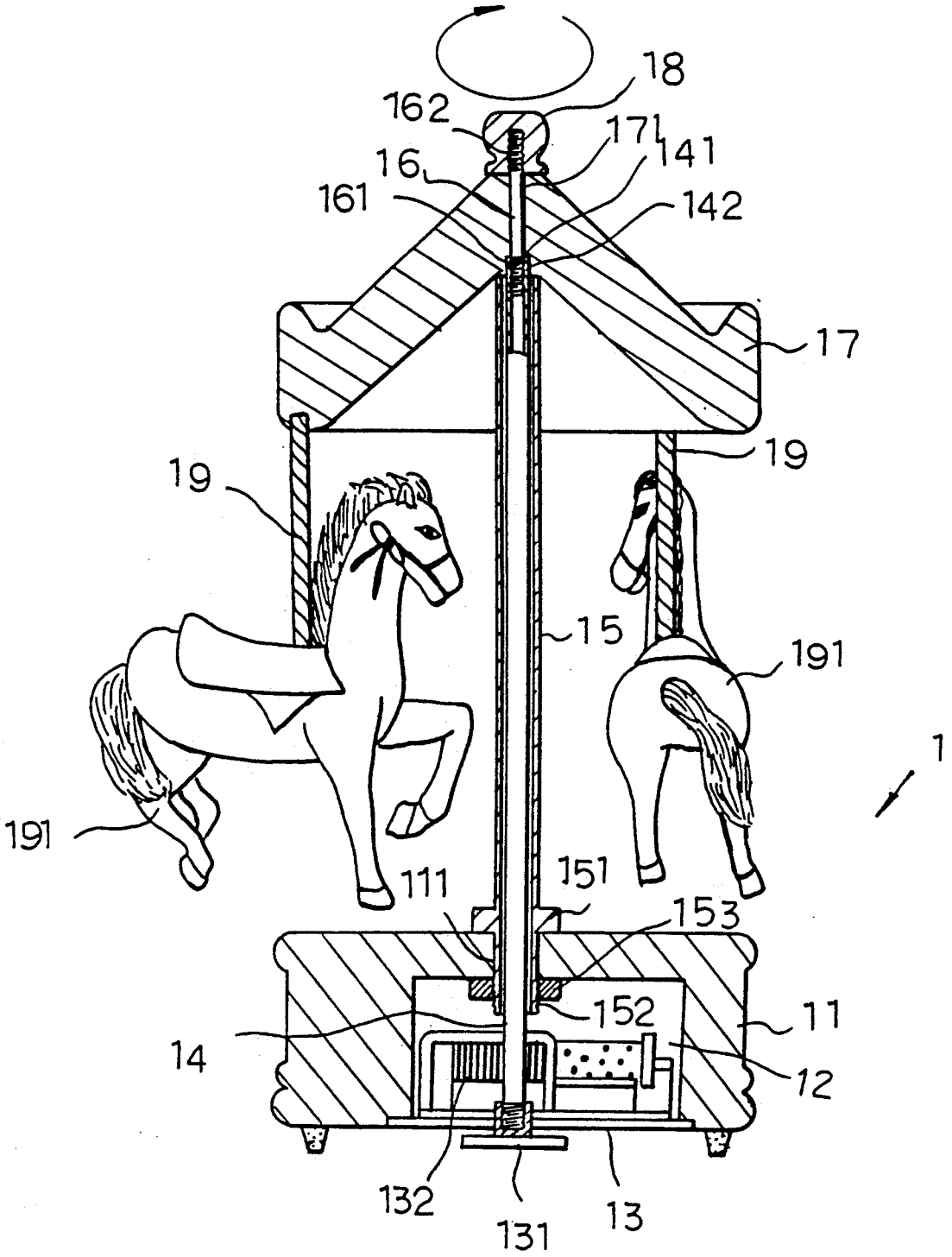
FIG.2(PRIOR ART)
FIG. 2 is a sectional view of the prior art music box.
Figure 3:
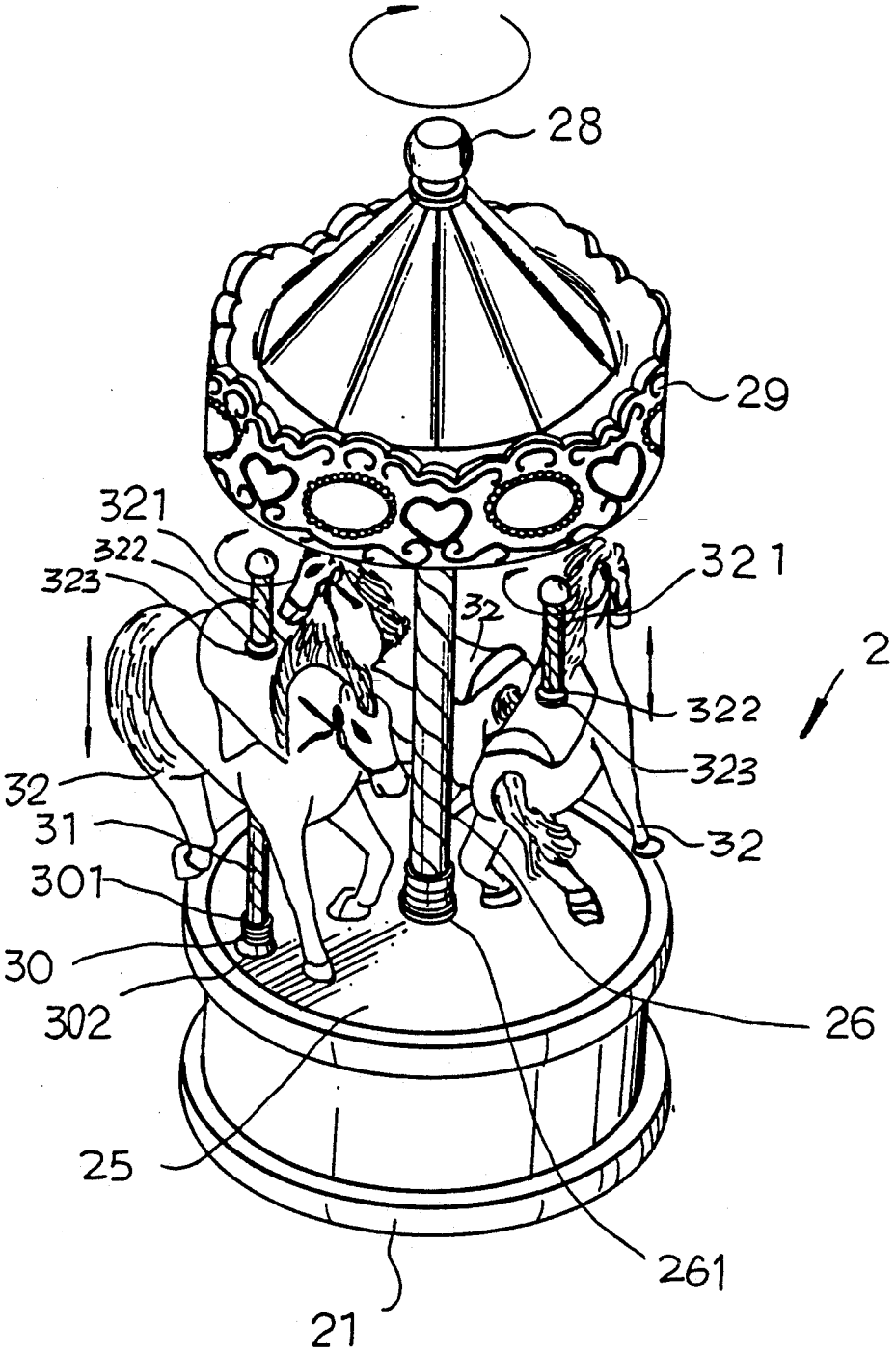
FIG. 3 is a perspective view of the present invention.
Figure 4:
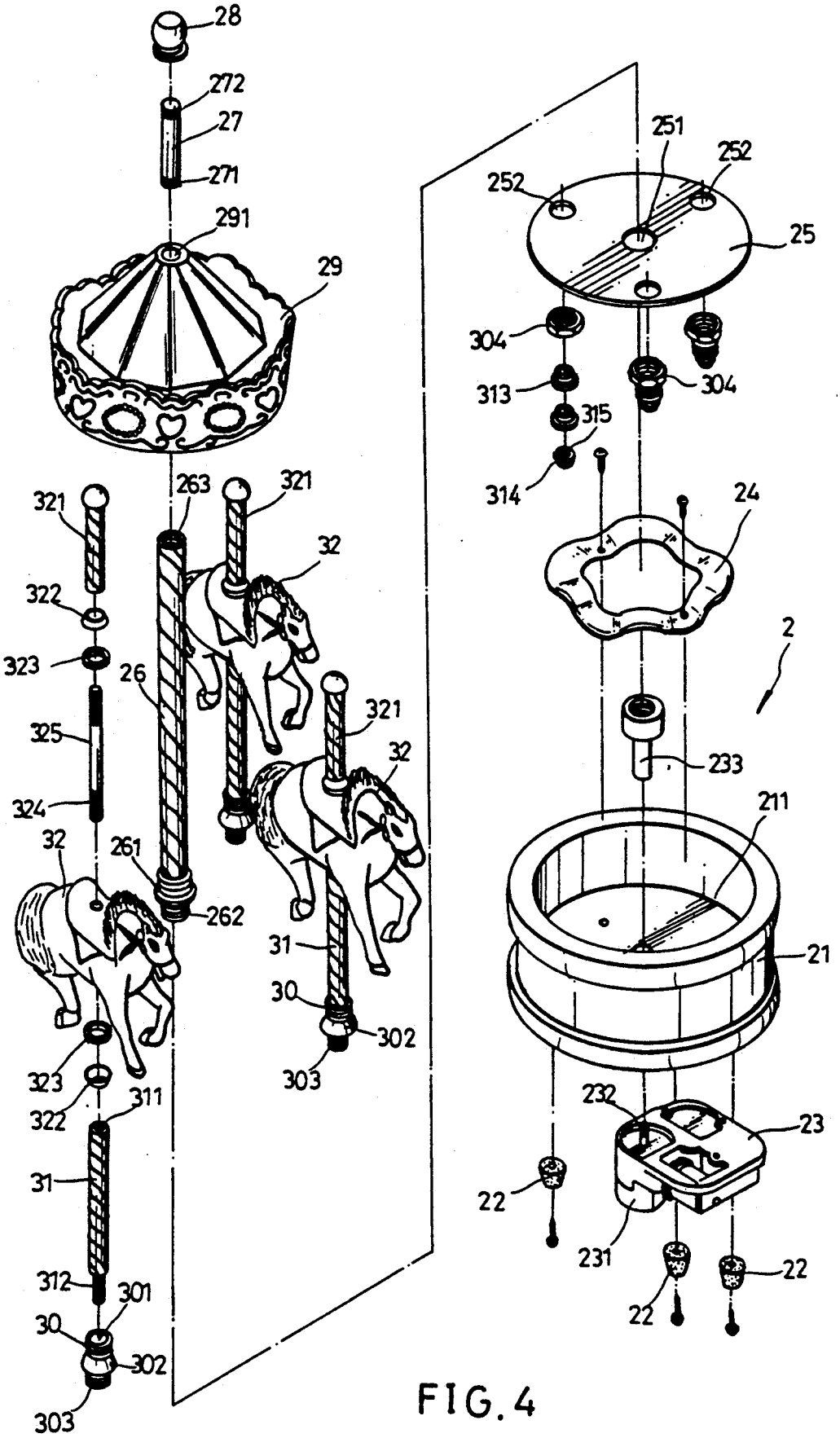
FIG. 4 is a perspective view of the exploded components of the present invention.

Referring to FIGS. 3, 4, the music box 2 of the present invention is provided with a mount case 21 having an upper housing cavity 211 and a lower housing cavity 212 and a number of supporting cushions 22 disposed at the bottom thereof; and a music producing and driving unit 23 received in the lower housing cavity 212; and a wave-shaped cam ring 24 disposed at the bottom of the upper housing cavity 211; and a round rotation disc 25 disposed at the top of the upper housing cavity 211.

A shaft 232 extended from the center of a driving spring 231 of the music producing and driving unit 23 is provided with a securing nut 233 at the top end thereof. A tubular main shaft 26 having inner threads 263 at the top end and outer threads 262 at the bottom end thereof can be removably engaged with the securing nut 233 when the bottom end thereof is led through a central through hole 251 of the rotation disc 25. A stop flange 261 disposed at the bottom end of the tubular main shaft 26 is in tight abutment against the rotation disc 25 when the same is screwed to the shaft 232 so that the main shaft 26 and the shaft 232 can be operated in synchronism. The inner threads 263 disposed at the top end of the tubular main shaft 26 permits of the screwing engagement of a connection rod 27 having outer threads 271, 272 disposed at the respective end thereof. To the top threaded end of the connection rod 27 is removably attached a decoration umbrella 29 having a through hole. 291 at the center thereof which is secured in place by .means of a nut knob 28 so as to make the decoration umbrella integrated with the main shaft 26.

Figure 5:
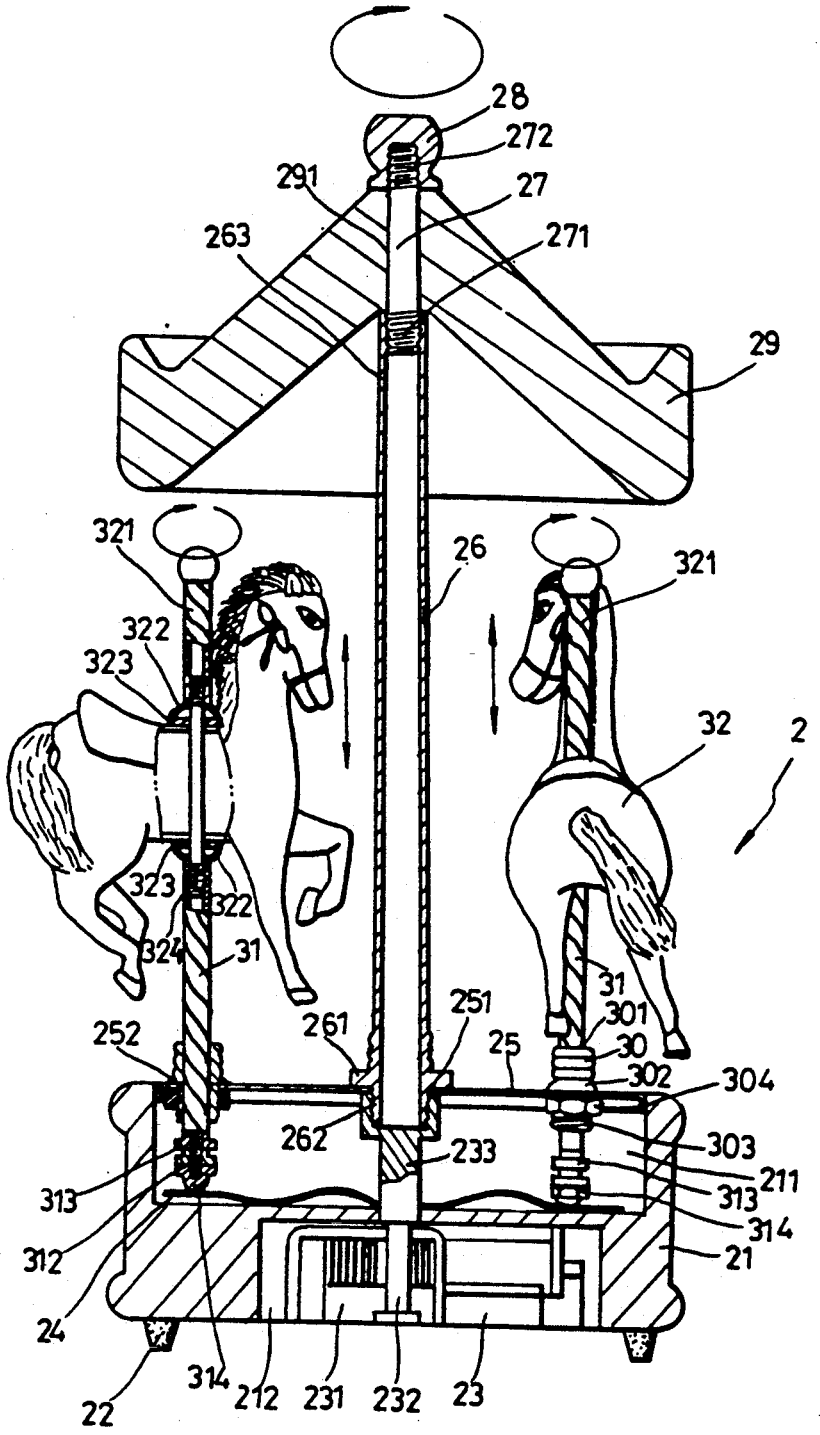
FIG. 5 is a sectional view of the present invention.

A number of symmetric through holes 252 disposed on the periphery of the rotation disc 25 are used for the location of a corresponding fixing member 30. A through hole 301 is disposed on the fixing member 30 which is provided with a skirt 302 at the middle thereof so that the same can be in limiting abutment against the surface of the rotation disc 25. The bottom end of the fixing member 30 is provided with outer threads 303 so as to permit the same to be secured to the underside of the rotation disc by way of a nut 304. Each fixing member 30 is disposed just above the wave-shaped cam ring 24 with a moveable rod 31 led through the through hole 301 thereof. The bottom end of the moveable rod 31 is provided with outer threads 312, as shown in FIG. 5, so that a ring 313 and a follower 314 having inner threads 315 can be engaged therewith. The moveable rod 31 is provided with inner threads 311 at the upper end thereof for the engagement of a connection pole 325 having outer threads 324 disposed at both ends thereof which is engaged with a fixing pole 321 at the other end. To the fixing pole 321 is mounted a decoration article 32 which is fixed in place by means of a pressure washer 322 and a ring 323.

The rotation of the decoration umbrella 29 can make the shaft 232 integrally connected to the tubular main shaft 26 spin simultaneously so as to get the driving spring 231 of the music producing and driving unit 23 tightened whereby the decoration umbrella 29 and the rotation disc 25 are provided with spinning power. As the rotation disc 25 rotates, each moveable rod 31 can move up and down in the fixing member 30 as a result of the follower 314 being in contact with the wave-shaped cam ring 24 which is fixed in place without rotation at the bottom of the upper housing cavity 21; in the meanwhile, the decoration article 32 mounted to each fixing pole 321 can be rotated 360 degrees around with the freely moveable rod 31 due to the wave contour of the cam ring 24.

Figure 6:
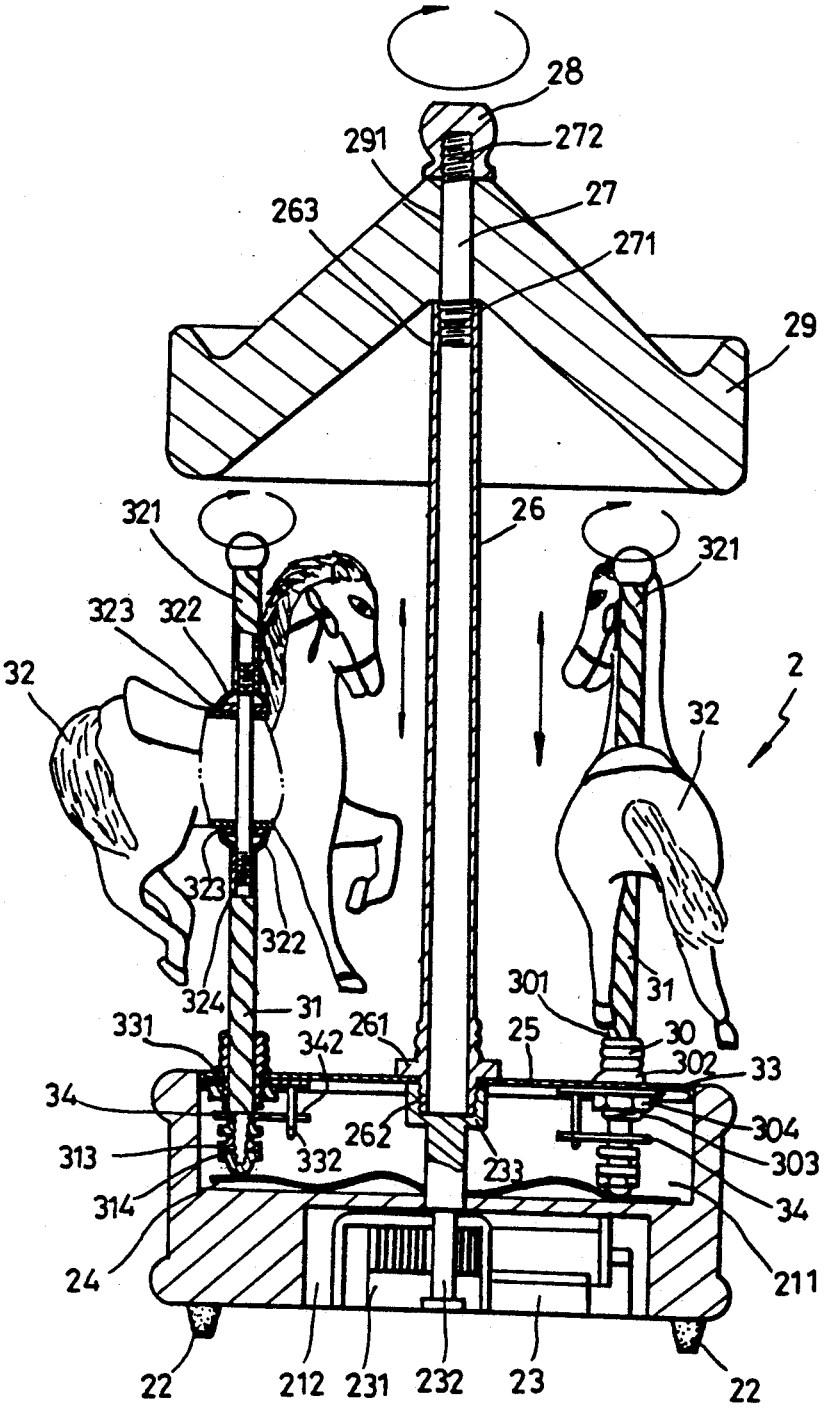
FIG. 6 is a diagram showing another embodiment of the present invention.
Figure 7:
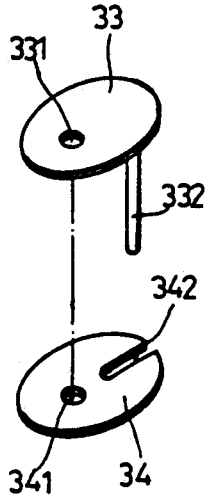

As shown in FIG. 6, a locking piece 33 having a central through hole 331 and a downwardly extended restraint pin 332 is secured under each through hole 252 of the rotation disc 25 to the fixing member 30 at a position between the bottom end having outer threads 303 and a nut 304. A stop piece 34 having a central hole 341 and a slot 342 with which the extended restraint pin 332 is selectively engaged is secured to the moveable rod 31 right above the ring 313 so that the moveable rod 31 is limited to move only up and down as a result of the cam ring 24 and without rotation and circularly with the rotation disc 25.

I claim:

1. An improved music box motion generation mechanism, comprising:

a mount case having an upper housing cavity and a lower housing cavity;

a rotation disc rotatably disposed at the top of said upper housing cavity having a central through hole and a number of symmetric through holes disposed on the periphery thereof;

a wave-shaped cam ring fixedly disposed at the bottom of said upper housing cavity;

a music producing and driving unit housed in said lower housing cavity having a driving shaft associated with a driving spring which can be tightened up by rotation of said shaft;

a securing nut engaged with said shaft of said music producing and driving unit;

a number of fixing members secured to said rotation disc by fastening means;

a number of moveable rods each of which is connected to a fixing pole by means of a connection pole being removably engaged with said fixing member;

a number of decoration articles each of which is securedly fixed to said connection pole and held firmly in place by washer means between said fixing pole and said moveable rod;

a tubular main shaft removably engaged with said securing nut at one end and associated with a decoration umbrella at the other end thereof by way of a connection rod and a fixing knob;

said rotation disc being associated with said wave-shaped cam ring by way of said moveable rods each provided with a follower means at the bottom end thereof so that the rotation of said rotation disc can make said moveable rods to travel along said fixed cam ring, permitting said moveable rods to move up and down and move circularly along with said rotation disc.

2. An improved music box motion generation mechanism as claimed in claim 1 wherein said wave-shaped cam ring is designed in such a manner that said moveable rod having a follower disposed at the bottom end thereof and a decoration article mounted thereto can be spinned 360 degrees around in addition to the circular motion in synchronism with said rotation disc.

3. An improved music box motion generation mechanism as claimed in claim 1 wherein said moveable rod is equipped with a stop piece which can be selectively engaged with a locking piece fixed to said rotation disc so that said moveable rod can be limited to move only up and down without spinning 360 degrees around.

4. An improved music box motion generation mechanism as claimed in claim 1 wherein said locking piece is provided with a downwardly extended restraint pin which is engaged with a slot of said stop piece so as to stop said moveable rod spinning around as the same moves along said wave-shaped cam ring.

* * * * *